US007055521B1

(12) United States Patent
Johnson

(10) Patent No.: US 7,055,521 B1
(45) Date of Patent: Jun. 6, 2006

(54) VENTILATED MASK FOR OUTDOOR USE

(76) Inventor: Ronald A. Johnson, 621 Main St., P.O. Box 301, Henderson, MN (US) 56044

( * ) Notice: Subject to any disclaimer, the term of this patent is extended or adjusted under 35 U.S.C. 154(b) by 227 days.

(21) Appl. No.: 10/714,427

(22) Filed: Nov. 17, 2003

Related U.S. Application Data

(60) Provisional application No. 60/494,414, filed on Aug. 13, 2003.

(51) Int. Cl.
*A62B 29/00* (2006.01)

(52) U.S. Cl. ..... 128/200.28; 128/201.12; 128/201.15

(58) Field of Classification Search ..... 128/200.27, 128/200.28, 201.12, 201.14, 201.15, 201.16, 128/201.17; 2/9, 427, 435, 436
See application file for complete search history.

(56) References Cited

U.S. PATENT DOCUMENTS

| | | | | | |
|---|---|---|---|---|---|
| 145,337 | A | * | 12/1873 | Crofutt | 128/206.19 |
| 1,048,191 | A | * | 12/1912 | Maurice | 2/206 |
| 1,077,177 | A | * | 10/1913 | Vagas | 2/84 |
| 1,286,476 | A | * | 12/1918 | Woloszczuk | 2/6.6 |
| 1,872,877 | A | * | 8/1932 | Bowers | 128/201.15 |
| 2,253,538 | A | * | 8/1941 | Sirch | 128/201.16 |
| 2,462,005 | A | * | 2/1949 | Schauweker | 128/207.11 |
| 2,669,717 | A | * | 2/1954 | Diggs | 2/9 |
| 2,762,368 | A | * | 9/1956 | Bloomfield | 128/206.28 |
| 3,152,588 | A | * | 10/1964 | Rogowski | 128/206.12 |
| 3,295,143 | A | * | 1/1967 | Hoffman | 2/12 |
| 3,298,031 | A | * | 1/1967 | Morgan | 2/9 |
| 3,768,100 | A | * | 10/1973 | Colman et al. | 2/9 |
| 3,823,418 | A | * | 7/1974 | Piper | 2/206 |
| 4,250,577 | A | * | 2/1981 | Smith | 2/427 |
| 4,285,068 | A | | 8/1981 | Ross | |
| 4,825,878 | A | * | 5/1989 | Kuntz et al. | 128/857 |
| 4,969,213 | A | | 11/1990 | Gruneisen, III | |
| 5,020,533 | A | * | 6/1991 | Hubbard et al. | 128/206.23 |
| 5,025,507 | A | * | 6/1991 | Kirby | 2/206 |
| 5,067,174 | A | * | 11/1991 | Ritchey et al. | 2/10 |
| 5,091,996 | A | | 3/1992 | Kirby | |
| 5,117,821 | A | | 6/1992 | White | |
| 5,129,103 | A | | 7/1992 | Gruneisen | |
| 5,406,944 | A | * | 4/1995 | Gazzara | 128/206.19 |
| 5,446,925 | A | * | 9/1995 | Baker et al. | 2/9 |
| 5,652,963 | A | | 8/1997 | Davison | |
| 5,682,879 | A | * | 11/1997 | Bowers | 128/206.19 |
| 5,704,063 | A | * | 1/1998 | Tilden | 2/9 |
| 5,797,146 | A | * | 8/1998 | Matich | 2/424 |
| 6,065,833 | A | * | 5/2000 | Tiano | 351/62 |
| 6,269,489 | B1 | | 8/2001 | Heath | |

* cited by examiner

*Primary Examiner*—Aaron J. Lewis
(74) *Attorney, Agent, or Firm*—John D. Gugliotta

(57) ABSTRACT

A ventilated mask for outdoor use is provided having a face mask to protect the wearer against insects and flying debris. The mask covers the user's nose, mouth and cheek area, and has a removable visor to provide protection for the eyes as well. The use of a snap in filter for additional protection against dust or other airborne irritants. The filter is held in place on the user's head by a pair of adjustable elastic straps. Finally, a hinged opening is provided in the mask area by the user's mouth to allow the insertion of game calling devices, drink bottles, straws, and the like, without requiring the user to remove the mask.

5 Claims, 3 Drawing Sheets

VENTILATED MASK FOR OUTDOOR USE

RELATED APPLICATIONS

The present invention contains subject matter that was first described in Disclosure Document Registration 524,109 filed on Jan. 6, 2003 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

The present invention claims benefit of U.S. Provisional Application 60/494,414 filed on Aug. 13, 2003 (Filing Receipt not yet received).

BACKGROUND OF THE INVENTION

1. Field of the Invention

The present invention relates generally to ventilated face guard devices and, more particularly, to a modular, adjustable "half helmet" design for such a face guard.

2. Description of the Related Art

As is well known in the art, a When participating in outdoor activities such as jogging, bike riding, walking, or just plain sitting on the porch, nothing puts a damper on things like the influx of mosquitos, moths, flies and other flying insects. Area foggers, bug lights, candles and the like provide some relief, but they are effective in one specific area only and do nothing for the person who moves around. If an insect repellent is used, they should not be used around the face, eyes, and mouth, and even if they were, they do not stop the errant insect from flying into one's mouth or eyes. Additionally, many activities such as bike riding, motorcycle riding, and the like, subject the participant to flying debris, dirt and the like which can hit the participant in the face.

Consequently, a need exists a need for a means by which people can be protected from insects, dirt, dust and flying debris, while participating in outdoor activities.

SUMMARY OF THE INVENTION

It is therefore an object of the present invention to provide an improved ventilated face guard device.

It is a feature of the present invention to provide an improved ventilated face guard devices that comprises a modular, adjustable "half helmet" design for such a face guard.

Briefly described according to one embodiment of the present invention, a ventilated mask for outdoor use is a face mask for outdoor use to protect the wearer against insects and flying debris. The invention covers the user's nose, mouth and cheek area, and has a removable visor to provide protection for the eyes as well. The invention is intended for use by hunters, joggers, bikers or anyone who requires face protection from foreign flying objects, such as insects, dirt or dust. The invention also provides for the use of a snap in filter for additional protection against dust or other airborne irritants. It is held in place on the user's head by a pair of adjustable elastic straps. Finally, a hinged opening is provided in the mask area by the user's mouth to allow the insertion of game calling devices, drink bottles, straws, and the like, without requiring the user to remove the mask.

The use of the ventilated mask for outdoor use provides facial protection for users against insects and airborne debris in a manner, which is quick, easy and effective.

In accordance with a preferred embodiment, a protective face mask for outdoor activities protects face against insects, dirt, and other airborne debris and contaminants An advantage of the present invention is the incorporation of a mask area that protects nose, mouth and cheeks.

Further, the present invention can be used with replaceable filters for trapping of finer materials such as pollen, dust, and the like.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
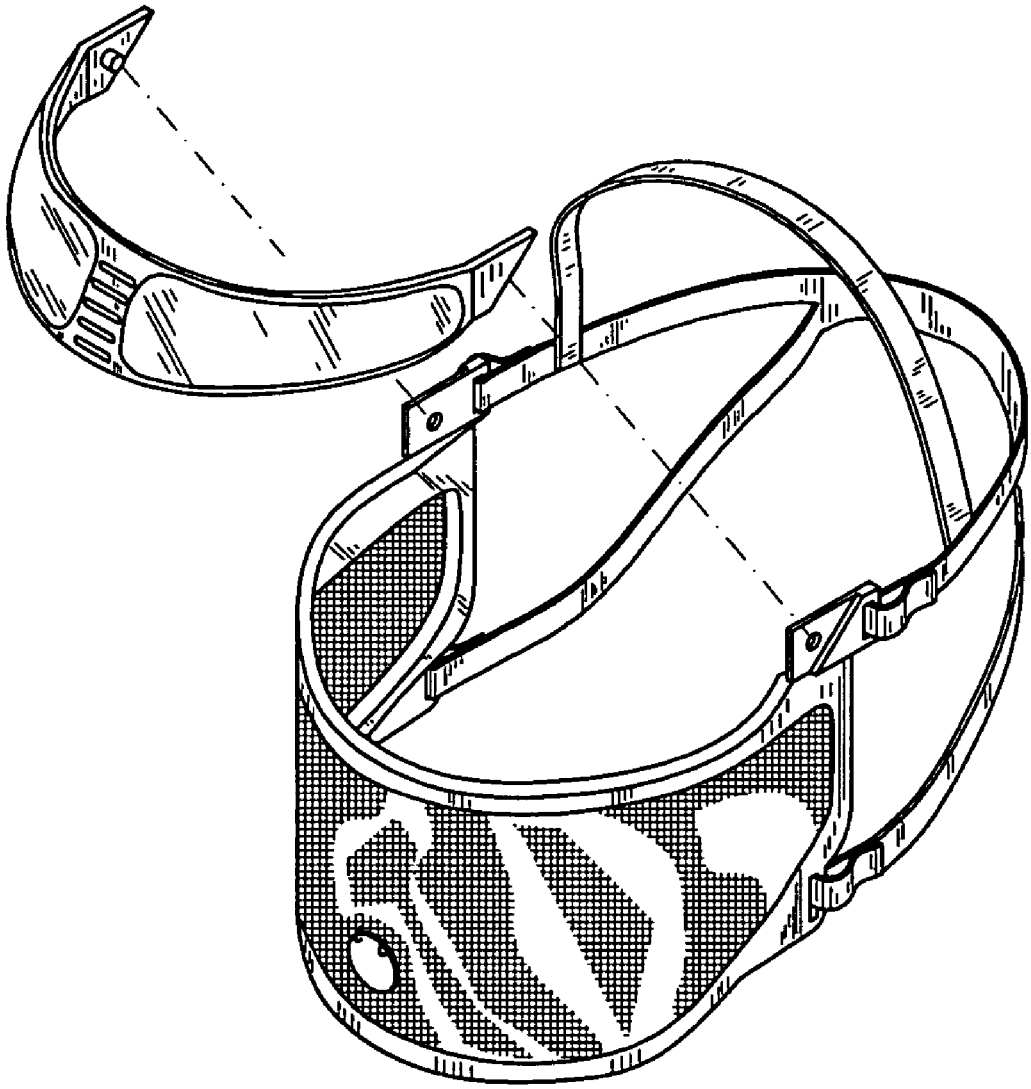
FIG. 1 is an exploded perspective view of a ventilated mask for outdoor use according to the preferred embodiment of the present invention.
Figure 2:
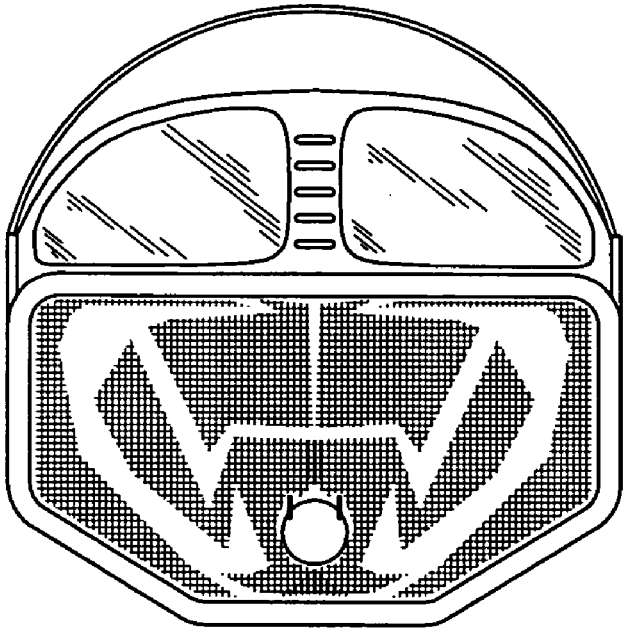
FIG. 2 is a front elevation view thereof.
Figure 3:
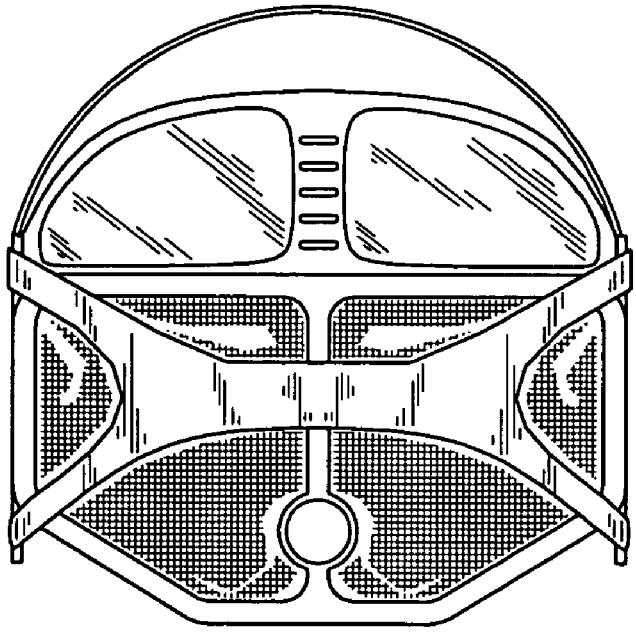
FIG. 3 is a rear elevation view thereof.
Figure 4:
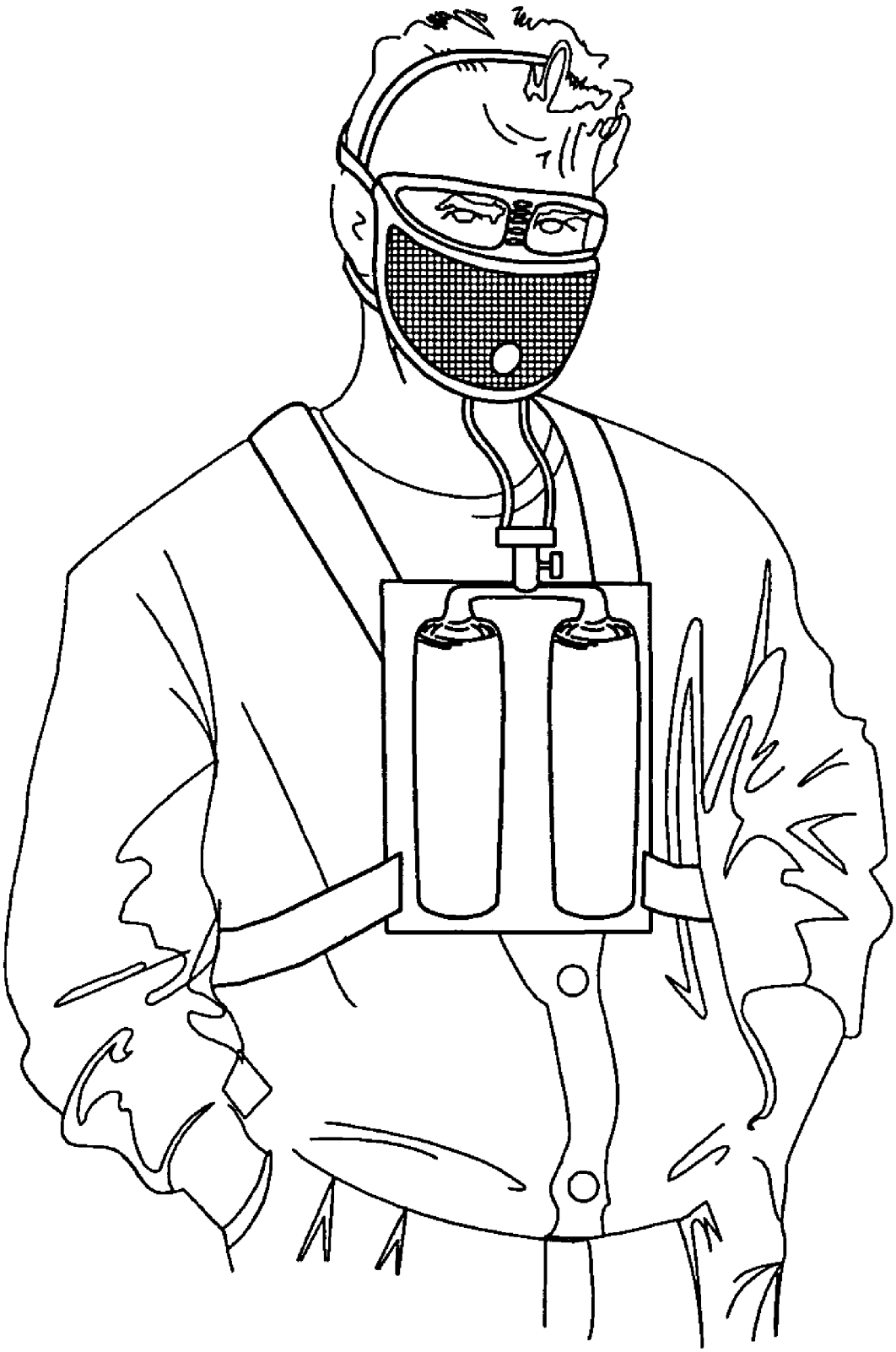
FIG. 4 is perspective view of an assembly illustrating the connectivity of an externally supported oxygen deliver means to the ventilated mask.

The best mode for carrying out the invention is presented in terms of its preferred embodiment, herein depicted within the FIGS. 1–4.

1. Detailed Description of the Figures

Referring now to FIG. 14, a ventilated mask for outdoor use 10 is shown, according to the present invention, an includes an upper visor 12, preferably constructed from plastic or another similar material, detachably affixed to a lower mask portion 14. It is anticipated that when the upper visor 12 is attached to the lower mask portion 14 the ventilated mask for outdoor use 10 together form a modular, adjustable "half helmet" design that functions as an air filter, a sun visor, and a face guard.

The upper visor 12 forms a visor frame 16 forming a pair of laterally spaced lens openings 18 separated by a bridge member 20. The bridge member 20 forms at least one ventilation aperture 22 for providing fluid communication between the space behind the visor and the outside atmosphere. Each lense opening 18 supports a clear lens element 24. It is anticipated that each lens 24 is formed of a clear, impact resistant material, and can include various features as would be available with eyeglasses, sunglasses, or visors including, but not limited to, polarization coatings, UV reduction, optical corrective lens, color filters, or the like. The lower frame member 16*b* further forms a connection means to connect physically with the lower mask portion 14, described in greater detail below.

The lower mask portion 14 is formed of a semi-pliable and form fitting outer frame 30, anticipated as being reinforced with a metal wire or similar semi-rigid structure. The outer frame 30 circumscribes a ventillation area 32 that is covered by a filter medium. The filter medium is washable or replaceable, allowing for the modular replacement of filter medium of varying and differing filtering capabilities, depending upon the particular need of the user.

Formed within the lower portion of the ventilation area 32 is an inlet aperture 36 covered from outside by a hinged cover 38. The cover 38 is coupled to and depending from the aperture 36.

2. Operation of the Preferred Embodiment

To use the present invention, the invention covers the user's nose, mouth and cheek area, and has a removable visor to provide protection for the eyes as well. The invention is intended for use by hunters, joggers, bikers or anyone who requires face protection from foreign flying objects, such as insects, dirt or dust. The invention also provides for the use of a snap in filter for additional protection against dust or other airborne irritants. It is held in place on the user's head by a pair of adjustable elastic straps. Finally, a hinged opening is provided in the mask area by the user's mouth to allow the insertion of game calling devices, drink bottles, straws, and the like, without requiring the user to remove the mask.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A ventilated mask comprising:

an upper visor detachably affixed to a lower mask portion, upper visor forming a visor frame supporting a pair of laterally spaced lens openings separated by a bridge member;

said bridge member forming at least one ventilation aperture for providing fluid communication between the space behind the visor and the outside atmosphere;

a pair of clear lens elements, one said clear lens element supported within each said lens opening;

said lower frame member further forming connection means to connect physically with a lower mask portion; and said lower mask portion, wherein said lower mask portion is formed of a semi-pliable and form fitting outer frame reinforced with a semi-rigid structure, said outer frame circumscribing a ventilation area that is covered by a filter medium.

2. The ventilated mask of claim 1, wherein said filter medium is washable and replaceable, allowing for the modular replacement of filter medium of varying and differing filtering capabilities.

3. The ventilated mask of claim 1, wherein formed within the lower portion of the ventilation area is an inlet aperture covered from outside by a hinged cover, said cover coupled to and depending from said aperture.

4. The ventilated mask of claim 1, wherein said upper visor forms a half-helmet formed of rigid material.

5. The ventilated mask of claim 1, wherein each lens is formed of a clear, impact resistant material including features as would be available with eyeglasses, sunglasses, or visors selected from the group comprising polarization coatings, UV reduction, optical corrective lens, color filters.

* * * * *